US005980371A

United States Patent [19]

McConnell

[11] Patent Number: 5,980,371

[45] Date of Patent: *Nov. 9, 1999

[54] ABRADING TOOL

[75] Inventor: Robert Bretney McConnell, Urbana, Ohio

[73] Assignee: The Desmond-Stephan Mfg. Co., Urbana, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 08/819,391

[22] Filed: Mar. 17, 1997

[51] Int. Cl.[6] ..... B24B 23/00

[52] U.S. Cl. ..... 451/352; 451/353; 384/41; 125/5; 30/306

[58] Field of Search ..... 451/548, 352, 451/158, 259, 353, 359, 451, 453, 456; 76/88 T; 384/41, 29; 125/5; 30/306, 307

[56] References Cited

U.S. PATENT DOCUMENTS

| | | | |
|---|---|---|---|
| 3,260,254 | 7/1966 | Collins | 125/5 |
| 3,263,665 | 8/1966 | Collins | 125/5 |
| 3,263,666 | 8/1966 | Collins | 125/5 |
| 3,309,729 | 3/1967 | Dresser | 15/236 |
| 3,351,046 | 11/1967 | Collins | 125/5 |
| 3,365,772 | 1/1968 | Collins | 29/81 |
| 3,451,721 | 6/1969 | Highberg et al. | 299/89 |
| 3,501,801 | 3/1970 | Fleur | 30/306 |
| 3,664,068 | 5/1972 | Metzger et al. | 51/209 |
| 3,942,208 | 3/1976 | Southard, Jr. | 15/104.01 |
| 4,155,596 | 5/1979 | Brejcha | 451/353 |
| 4,188,696 | 2/1980 | Collins et al. | 29/81 |
| 4,634,188 | 1/1987 | Persson | 125/5 |
| 4,714,294 | 12/1987 | Swan | 451/352 |
| 5,503,203 | 4/1996 | Stornetta | 451/456 |
| 5,540,616 | 7/1996 | Thayer | 451/456 |
| 5,545,080 | 8/1996 | Clowers et al. | 451/456 |

OTHER PUBLICATIONS

McGrawHill Dictionary of Scientific and Technical Terms 5th Edition, 1974.

Jensen's Engineering Drawing and Design, 1968.

A publication of the Post Office Department, Washington D.C. 20260, Reprinted from the Facilities Handbook—Maintenance Series MS–22, "Street Letter Box Maintenance", dated Jun. 1966.

*Primary Examiner*—Robert A. Rose
*Assistant Examiner*—George Nguyen
*Attorney, Agent, or Firm*—Biebel & French

[57] ABSTRACT

An improved abrading tool adapted for being driven in rotation by a power tool is disclosed. The abrading tool includes a single piece housing having concentric inner and outer cylindrical walls. A plurality of abrading disc assemblies are in equal circumferentially spaced relation between the inner and outer cylindrical walls. Each abrading disc assembly includes an axle having an integral head and a key means adjacent the under side of the head adapted to be engagable with a keyed radial aperture of the inner wall for preventing rotation of the axle relative to the housing. A bushing is removably mounted on each axle between the inner and outer walls of the abrading tool. The bushing includes a flange formed at one end thereof adapted to be engagable with the outer wall of the housing. A plurality of abrading discs are rotatably mounted on each bushing wherein the flange is adapted to prevent contact between the abrading discs and the outer wall of the abrading tool.

11 Claims, 4 Drawing Sheets

ABRADING TOOL

BACKGROUND OF THE INVENTION

1. Field of the Invention

The present invention relates to abrading devices and, more particularly, to an abrading tool adapted to be driven in rotation by a conventional power tool, such as a portable drill or grinder, for abrading various surfaces for a variety of purposes, such as paint and rust removal, smoothing masonry and similar operations.

2. Description of the Prior Art

The present invention is an improvement upon the general abrading tool as disclosed in U.S. Patent No. 3,365,772 to Collins and U.S. Pat. No. 4,188,696 to Collins et al. which are hereby incorporated by reference. While the tool disclosed in these patents has been successfully utilized in abrading surfaces, it has proven difficult to replace worn abrading discs mounted within this tool. Further, this prior art abrading tool is not compatible with abrading discs having substantially different mounting hole diameters.

More particularly, the above-referenced patents disclose an abrading tool including a plurality of nested open bottom coaxially positioned cylindrical cups through which a coaxial spindle is rigidly secured. The cylindrical cups include an outer housing, an inner housing, and an intermediate housing disposed therebetween. A plurality of radially disposed axles are supported within and extend between the intermediate and outer housings. Each axle rotatably supports a plurality of abrading discs interspaced with washers, wherein the abrading discs project beyond the open end of the housings for abrading material that is to be removed from a surface. The inner end of each axle carries an enlarged head engaging the inner and intermediate housings, thereby securing the axle from radial movement.

As mentioned above, it has been difficult to replace worn abrading discs in the prior art abrading tool. The abrading discs of this tool include a mounting hole through which the axle extends wherein the plurality of mounting discs, as well as the washers, are rotatably supported in direct contact with the axle. Removal of the axle from its position between the outer and intermediate housings results in the plurality of abrading discs and washers separating in a random and unorganized manner. Reassembly of the abrading tool is a challenging task in that the mounting holes of the plurality of abrading discs must be coaxially aligned with the interspaced washers and held in position between the intermediate and outer housings. Simultaneously, the axle must be aligned with the coaxial holes in the intermediate and outer housings while being passed through the abrading discs and washers.

A further limitation of the prior art abrading tool is that only abrading discs having a mounting hole of substantially the same diameter as the axle may be utilized. Abrading discs of different mounting hole diameters may not be used interchangeably since a mounting hole diameter which is substantially larger than the diameter of the axle will not allow for the proper rotation of the abrading disc on the axle.

Accordingly, there remains a need for an improvement to the prior art abrading tool facilitating the disassembly and reassembly of the tool for the replacement of worn abrading discs. Further, there remains a need for an abrading tool permitting the interchangeable use of abrading discs having different mounting hole diameters.

SUMMARY OF THE INVENTION

The present invention is a modification of the previously described abrading tool which overcomes the above-mentioned difficulties.

The abrading tool of the present invention is adapted for being driven in rotation by a spindle attached to a power tool, such as a portable drill or grinder. The abrading tool comprises a single piece housing including a cylindrical outer wall defining a longitudinal axis and having a plurality of radial apertures. A cylindrical inner wall is concentric to the outer wall and includes a plurality of keyed radial apertures coaxial to the radial apertures of the outer wall. A top wall is integral with the inner and outer walls and includes a threaded aperture coaxial with the longitudinal axis.

A retaining cup including a cylindrical retaining wall is concentrically received within the inner wall of the housing. The retaining cup further includes an end cap having an aperture coaxial to the longitudinal axis. The retaining wall and the inner wall define a predetermined space of substantially uniform width therebetween. The apertures of the housing top wall and the retaining cup end cap are adapted to receive a spindle including a fastening means on a lower end thereof for securing the end cap in adjacent relation to the top wall.

A plurality of abrading disc assemblies are circumferentially spaced between the outer and inner walls of the housing. Each abrading disc assembly includes an axle, a bushing, a plurality of abrading discs and a plurality of washers.

The axles are positioned in and extend between the coaxial radial apertures of the outer wall and the inner wall wherein the axles are in equal circumferentially spaced relation normal to the longitudinal axis. Each of the axles includes an integral head positioned in the predetermined space between the retaining wall and the inner wall for securing each of the axles in equal fixed relation with respect to the longitudinal axis. The head of each axle includes a gripping surface for engaging the retaining wall of the retaining cup. A key means is located adjacent the underside of the head on each axle and is engagable with one of the plurality of keyed radial apertures within the inner wall thereby preventing rotation of the axle.

The bushings are removably mounted on the axles between the outer wall and the inner wall of the housing. Each bushing includes a cylindrical shaft having first and second ends and an aperture extending between the first and second ends for slidably receiving one of the axles. An integral flange is positioned at the second end of the bushing. A plurality of abrading discs having mounting holes are rotatably mounted on each bushing and are retained between the flange and the inner wall. The flange of each bushing is engagable with the outer wall of the housing thereby preventing contact between the abrading discs and the outer wall. As the spindle is driven in rotation, the housing will rotate thereby causing the abrading discs to rotate and abrade a surface in contact therewith.

The abrading disc assembly of the present invention permits the efficient and organized removal and installation of the bushing, abrading discs and washers as a single unit. Further, it may be appreciated that bushings having different outside diameters may be interchanged with each other as supported on each axle, such that abrading discs having different diameter mounting holes may be utilized within the abrading tool.

Therefore, it is an object of the present invention to provide an abrading tool of simple design that may be easily disassembled and reassembled.

It is yet another object of the invention to provide an abrading tool which facilitates efficient and simple replacement of abrading discs.

It is a further object of the invention to provide an abrading tool permitting the use of abrading discs having mounting holes of different diameters.

Other objects and advantages of the invention will be apparent from the following description, the accompanying drawings and the appended claims.

DETAILED DESCRIPTION OF THE PREFERRED EMBODIMENT

Figure 1:
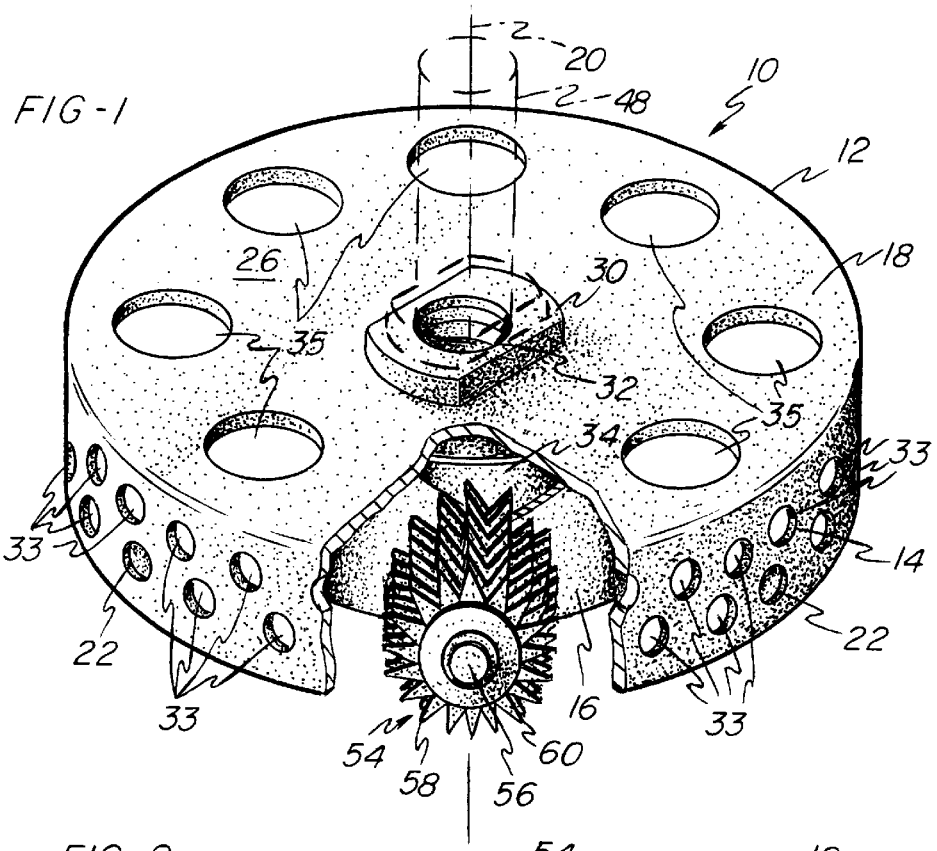
FIG. 1 is a perspective view with a partial cutaway of the abrading tool of the present invention.
Figure 2:
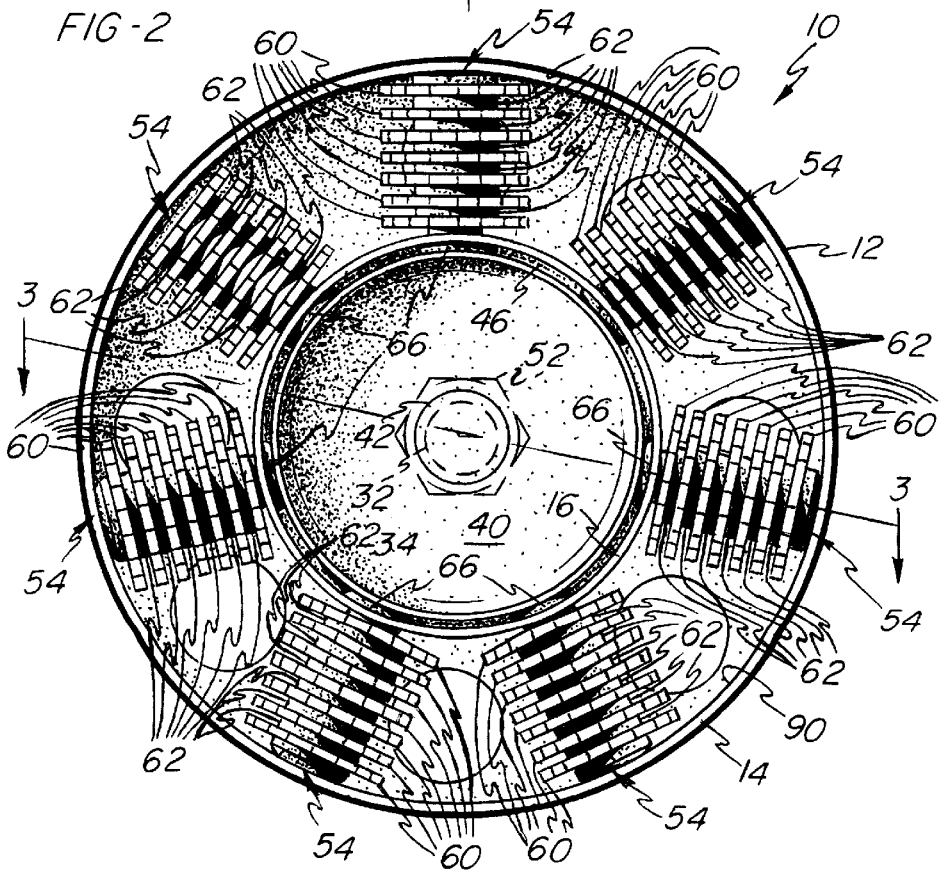
FIG. 2 is a bottom plan view of the abrading tool of the present invention.
Figure 3:
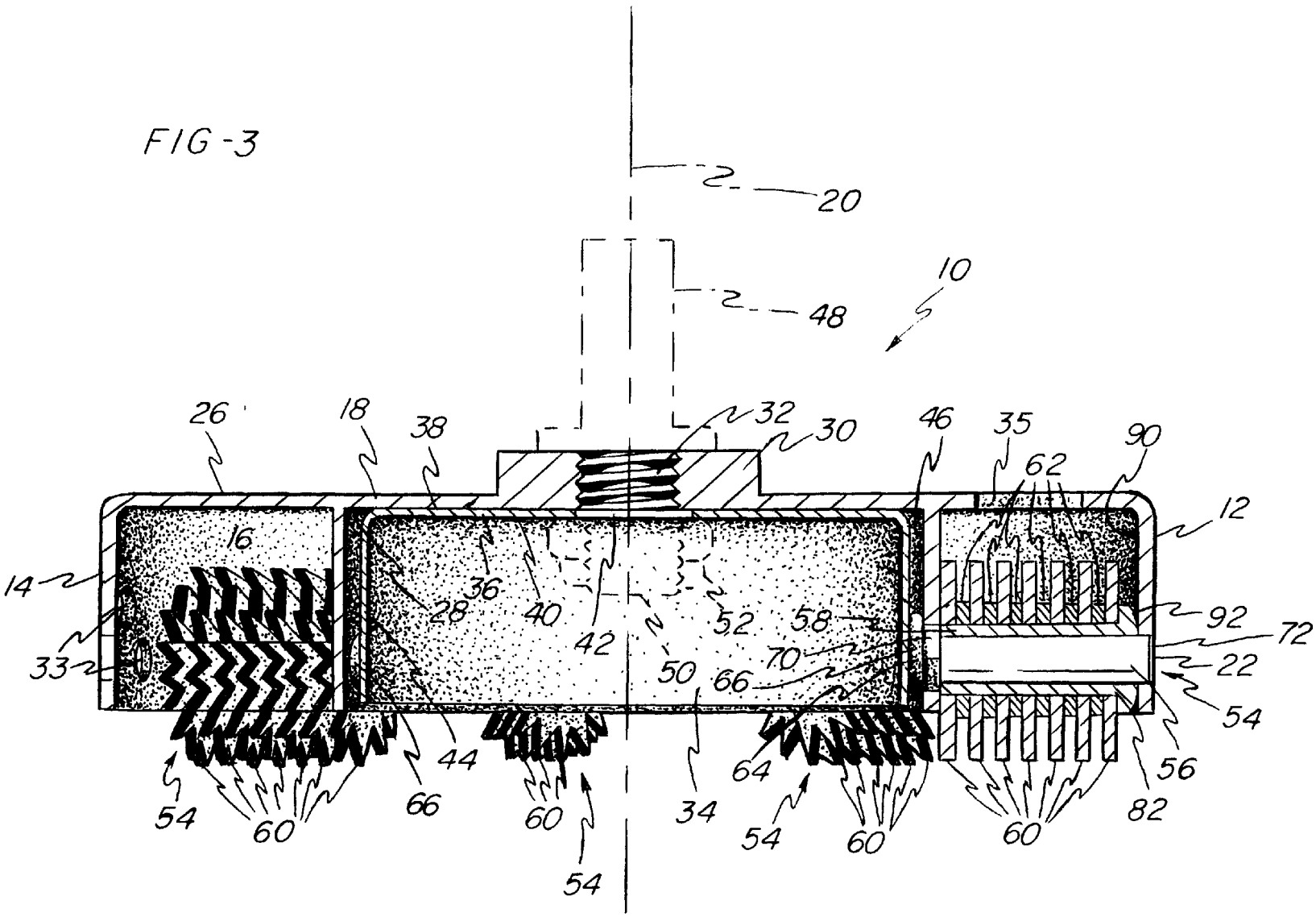
FIG. 3 is a cross-sectional view taken along line 3—3 in FIG. 2.

Referring initially to FIGS. 1–3, the abrading tool 10 of the present invention is shown as including a cup-shaped housing 12 preferably formed as a single cast piece and having cylindrical outer and inner walls 14 and 16 integral with a top wall 18. The single piece cast housing 12 is more balanced than typical prior art multiple piece housings since the substantially uniform distribution of material is ensured. Further, there is no fastening member securing the inner wall 16 to the remainder of the housing 12 as in prior art tools, thereby eliminating a potential failure point and increasing safety.

The cylindrical outer wall 14 defines a longitudinal axis 20 through its geometric center and includes a plurality of equally spaced radial apertures 22. The cylindrical inner wall 16 is located concentrically within the outer wall 14 whereby the inner wall 16 extends parallel to the outer wall 14 and is spaced radially inward therefrom. A plurality of keyed radial apertures 24 (FIG. 4), preferably having a square shape, are formed within the inner wall 16 and are aligned coaxially with the radial apertures 22 of the outer wall 14. The top wall 18 includes substantially planar top and bottom surfaces 26 and 28 wherein a shoulder 30 is integrally formed with the top wall 18. The shoulder 30 is centered on the longitudinal axis 20 and extends from the top surface 26. A threaded aperture 32 extends through the top wall 18 and shoulder 30 and is coaxial with the longitudinal axis 20.

As shown in FIG. 1, the housing 12 may include a plurality of vent apertures 33 and 35 for facilitating the removal of hazardous airborne dust during operation of the abrading tool 10. Vent apertures 33 are formed in two rows within the outer wall 14 between the radial apertures 22. Vent apertures 35 are circumferentially equally spaced within the top wall 18 near the outer periphery thereof. A shielded cover (not shown) of the type well known in the art may be placed over the housing 12 for pulling a vacuum through the vent holes 33 and 35 and collecting dust within a proper receptacle (not shown).

A retaining cup 34 is mounted concentrically within the inner wall 16 of the housing 12. The retaining cup 34 includes an end cap 36 having substantially planar top and bottom surfaces 38 and 40. The top surface 38 of the end cap 36 engages the bottom surface 28 of the top wall 18 of the housing 12. An aperture 42 is formed within the end cap 36 and is coaxial with the longitudinal axis 20 thereby aligning with the threaded aperture 32 of the top wall 18 of the housing 12. A cylindrical retaining wall 44 extends down from the end cap 36 concentric to the inner wall 16 of the housing 12 wherein the retaining wall 44 and the inner wall 16 define a predetermined space 46 of substantially uniform width therebetween.

The abrading tool 10 is adapted to receive a spindle 48 for attachment to a power-driven chuck (not shown), such as the chuck of an electric, hydraulic or pneumatic drill, sander, grinder or polisher. The spindle 48 has a male threaded lower end segment 50 which is threadably received within the aperture 32 of the top wall 18 and extends down through the aperture 42 of the end cap 36. The retaining cup 34 is secured to the housing 12 by a fastening means, preferably a nut 52, which threadably engages the threaded lower end segment 50 of the spindle 48 below the end cap 36 such that the end cap 36 is secured in adjacent relation to the top wall 18.

Figure 4:
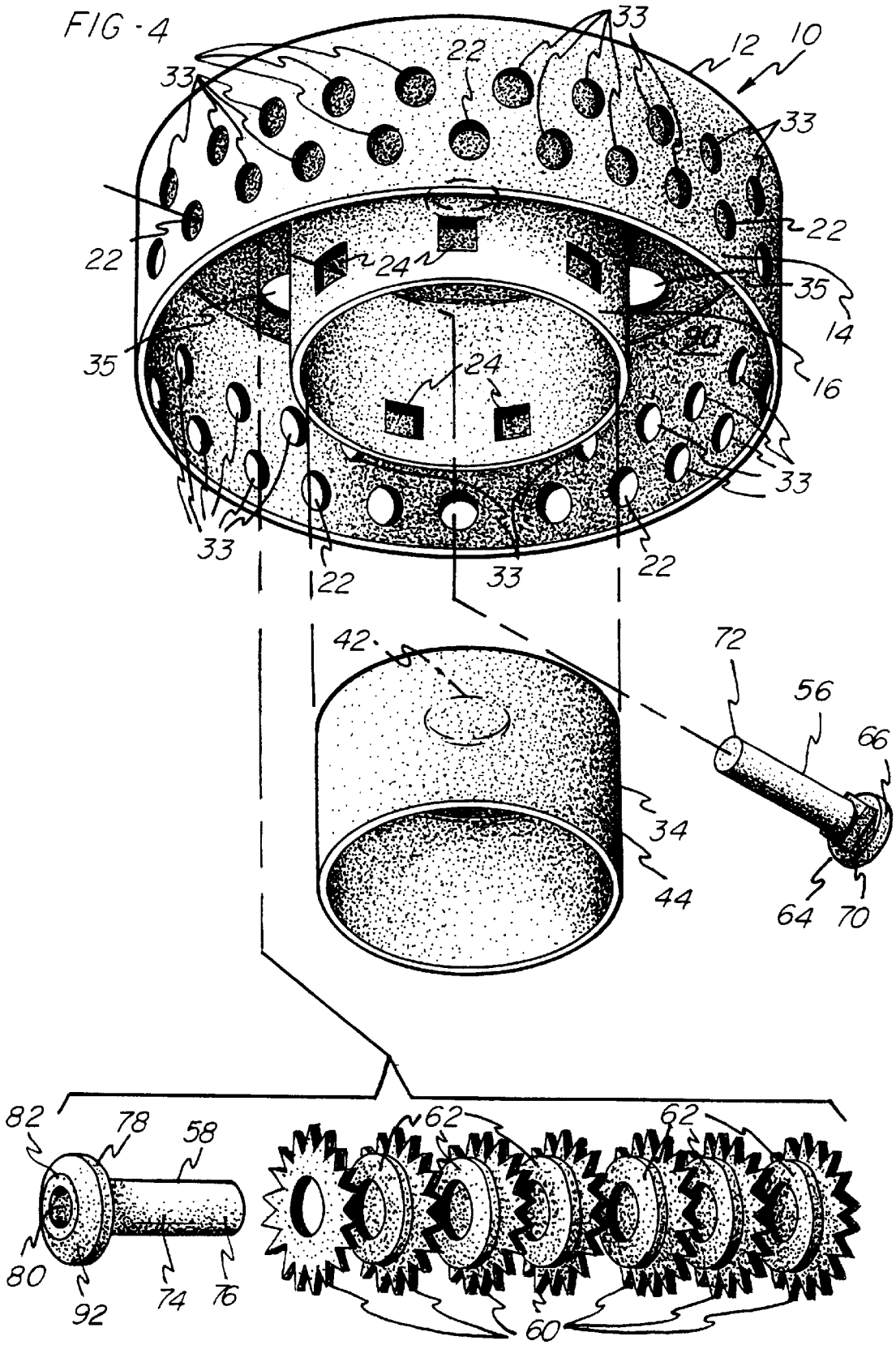
FIG. 4 is a perspective exploded view illustrating the principal elements of the abrading tool of the present invention.
Figure 5:
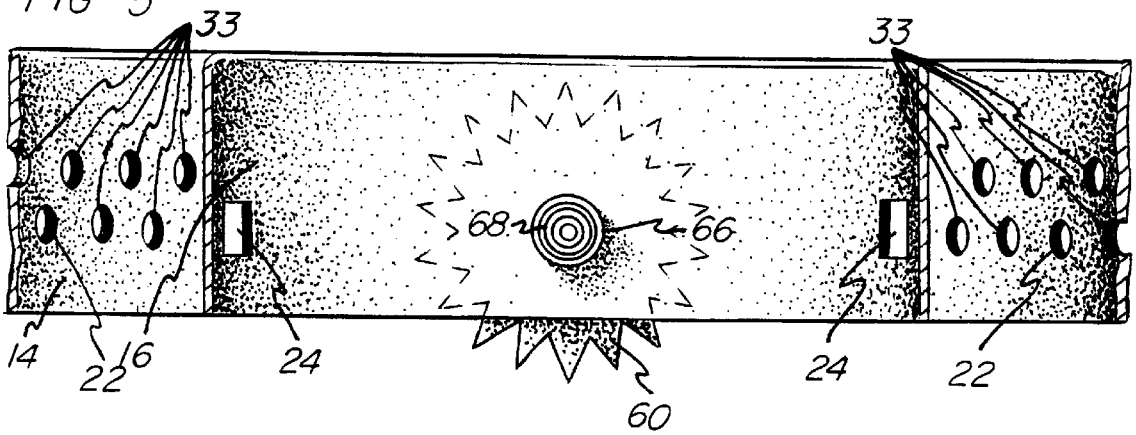
FIG. 5 is a front elevation view of the abrading disc assembly of the present invention as mounted within the housing of the abrading tool.
Figure 6:
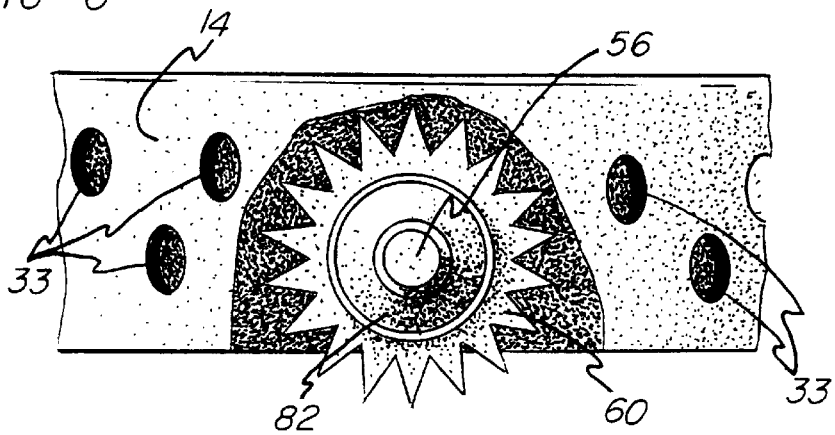
FIG. 6 is a rear elevation view thereof.

The outer and inner walls 14 and 16 of the housing 12 support a plurality of circumferentially equally spaced abrading disc assemblies 54, shown in FIG. 2 to be seven in number. Turning now to FIGS. 3–6, each abrading disc assembly 54 includes an axle 56, a bushing 58, a plurality of abrading discs 60 and a plurality of washers 62. The axles 56 are circumferentially spaced normal to the longitudinal axis 20 wherein each axle 56 extends through the inner wall 16 radially outwardly to the outer wall 14 of the housing 12. An inner end 64 of each axle 56 includes an integral enlarged head 66 positioned in the predetermined space 46 between the retaining wall 44 and the inner wall 16. The thickness of the head 66 is slightly greater than that of the predetermined space 46 such that the head 66 frictionally engages the inner wall 16 and retaining wall 44 thereby causing locking engagement therebetween for securing each axle 56 in equal fixed relation with respect to the longitudinal axis 20. A gripping surface 68, shown as a plurality of raised concentric circles in FIG. 5, is provided on the inside surface of the head 66 to facilitate locking engagement between the axle 56 and the retaining cup 34.

A key means, preferably a squared segment 70, is formed on the axle 56 adjacent the underside of the head 66. The squared segment 70 is snugly received in the keyed aperture 24 of the inner wall 16 of the housing 12 to prevent rotation of the axle 56 with respect to the housing 12. While the axles 56 are prevented from rotating by the engagement of the squared segment 70 under each head 66 with one of the keyed apertures 24 of the inner wall 16, equivalent keying may be accomplished in any of a number of well known techniques.

An outer end 72 of each axle 56 is slidably received within one of the apertures 22 in the outer wall 14 of the housing 12 wherein the axle 56 does not project radially outside the outer wall 14 (FIG. 3), thereby preventing damage when the outer wall 14 contacts a surface vertical to that being abraded.

The bushings 58 are removably mounted on the axles 56 between the outer and inner walls 14 and 16 of the housing 12. As seen in FIG. 4, each bushing 58 includes a cylindrical shaft 74 having an outer diameter and first and second ends 76 and 78. An aperture 80 extends between the first and second ends 76 and 78 of the shaft 74, wherein the aperture 80 defines an inner diameter of the shaft 74. The inner diameter of the shaft 74 is slightly greater than the outer diameter of the axle 56 such that the bushing 58 is slidably received on the axle 56. An integral flange 82 having an outer diameter greater than that of the shaft 74 is positioned at the second end 78 of the bushing 58.

Figure 7:
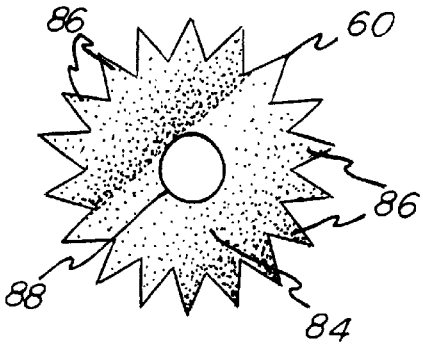
FIG. 7 is a front elevation view of an abrading disc.

Each bushing 58 rotatably supports a plurality of abrading discs 60 preferably made of hardened steel, although any suitable high wear resistant material may be substituted therefor. As seen in FIG. 7, each abrading disc 60 includes a body 84 supporting a plurality of teeth 86. A mounting hole 88 is centered within the body 84 for receiving the bushing 58 wherein the mounting hole 88 has a diameter slightly greater than the outer diameter of the bushing 58, thereby permitting relative rotational movement between the abrading disc 60 and bushing 58. The diameter of the mounting hole 88 is, however, less than the outer diameter of the flange 82 whereby the abrading discs 60 may not pass off the second end 78 of the bushing 58.

The abrading discs 60 are separated from each other along the bushing 58 by flat metal washers 62. The abrading discs 60 and washers 62 are retained between the flange 82 and the inner wall 16 of the housing 12 wherein the flange 82 is engagable with an inner surface 90 of the outer wall 14, thereby preventing damaging contact between the abrading discs 60 and housing 12. A beveled surface 92 is provided on the flange 82 to facilitate contact between the flange 82 and the cylindrical inner surface 90 of the outer wall 14. As shown in FIG. 3, the teeth 86 of the abrading discs 60 extend below an open end of the housing 12 for abrading material that is to be removed from the surface to be cleaned.

Turning again to FIG. 4, it may be appreciated that the present invention facilitates the efficient disassembly and reassembly of the abrading tool 10 for the replacement of worn abrading discs 60 since the abrading discs 60 are supported on removable bushings 58. Removal of the axle 56 from within the bushing 58 allows the bushing 58, abrading discs 60 and washers 62 to be withdrawn from the housing 12 as a single compact unit.

Reassembly is a simple matter in that the replacement abrading discs 60 and washers 62 are arranged over the shaft 74 of the bushing 58 and held in place against the flange 82. The bushing 58, abrading discs 60 and washers 62 are then placed, as a single unit, between the outer and inner walls 14 and 16 of the housing 12. The axle 56 is next passed through one of the radial apertures 24 of the inner wall 16 and the aperture 80 within the bushing 58 until the head 66 engages the inner wall 16. At this point, the outer end 72 of the axle 56 is received within the radial aperture 22 of the outer wall 14 and the squared segment 70 of the axle 56 is received within the keyed radial aperture 24 of the inner wall 16. Assembly is complete when the retaining cup 34 is concentrically fixed within the housing 12 by the nut 52 threadably engaging the spindle 48 whereby the axles 56 are fixed relative to the longitudinal axis 20.

Furthermore, the abrading tool 10 of the present invention permits the use of abrading discs 60 having mounting holes 88 of different diameters. Since the bushings 58 are removably mounted on the axles 56, bushings 58 having different outside diameters may be interchanged with each other. Abrading discs 60 with mounting holes 88 having a diameter substantially different from the diameter of the axle 56 may therefore be mounted within the housing 12 by being placed over a bushing 58 with an outside diameter slightly less than the diameter of the mounting hole 88. The versatility of the abrading tool 10 is greatly enhanced since a wide variety of abrading discs 60 may be utilized.

From the above description it should be apparent that the present invention provides an abrading tool 10 which facilitates disassembly and reassembly for the replacement of worn abrading discs 60. Further, the abrading tool 10 of the present invention permits the interchange of abrading discs 60 having different mounting hole 88 diameters.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. An abrading tool for being driven in rotation by a spindle attached to a power tool, said abrading tool comprising:

a housing including a cylindrical outer wall defining a longitudinal axis and having an arcuate inner surface and a plurality of radial apertures, a cylindrical inner wall concentric to said outer wall and having a plurality of radial apertures coaxial to said radial apertures of said outer wall, and a top wall connected to said inner and outer walls and having an aperture coaxial with said longitudinal axis;

a retaining cup including a cylindrical retaining wall concentrically received within said inner wall of said housing, and an end cap having an aperture coaxial with said longitudinal axis, said retaining wall and said inner wall defining a predetermined space of substantially uniform width therebetween;

a plurality of axles positioned in and extending between said coaxial radial apertures of said inner wall and said outer wall wherein said axles are in a circumferentially spaced relation normal to said longitudinal axis;

wherein each of said axles includes an integral head having a thickness greater than said predetermined space between said retaining wall and said inner wall, each said head positioned in said predetermined space for securing each of said plurality of axles in equal fixed relation with respect to said longitudinal axis;

a plurality of infrangible hardened cylindrical bushings removably and rotatably mounted on said plurality of axles between said outer wall and said inner wall of said housing;

wherein each of said plurality of bushings includes a cylindrical shaft having a shaft outer diameter and first and second ends, an aperture extending between said first and second ends for slidably receiving one of said plurality of axles, and an integral flange positioned at said second end;

wherein said flange has a flange outer diameter greater than said shaft outer diameter and is rotatably engageable with said outer wall of said housing;

a plurality of hardened planar abrading discs removably and rotatably mounted on each of said bushings for continuous rotating bearing contact therewith, each of said plurality of abrading discs including a central mounting hole having a diameter intermediate said shaft outer diameter and said flange outer diameter and a plurality of teeth extending radially outwardly from said central mounting hole; and said abrading discs are retained between said outer wall and said flange whereby said abrading discs rotate and abrade a surface when in contact therewith as said housing is rotated and said abrading discs are prevented from contacting said arcuate inner surface of said outer wall.

2. The abrading tool according to claim 1 wherein said top wall of said housing is integral with said outer wall and said inner wall.

3. The abrading tool according to claim 1 wherein said radial apertures of said inner wall are keyed and each of said plurality of axles includes a key means adjacent the under side of said head, said key means engagable with one of said plurality of said radial apertures of said inner wall for preventing rotation of said axle relative to said housing.

4. The abrading tool according to claim 1 wherein said head of each of said plurality of axles includes a gripping surface for engaging said retaining wall of said retaining cup.

5. The abrading tool according to claim 1 wherein said flange includes a beveled surface to facilitate contact between said flange and said outer wall.

6. An abrading disc assembly adapted for being supported by an abrading tool, said abrading disc assembly comprising:

an axle adapted for being positioned in and extending between concentric inner and outer walls of an abrading tool, said axle including an integral head;

an infrangible hardened cylindrical bushing removably and rotatably mounted on said axle and adapted for being positioned between inner and outer walls of an abrading tool, said bushing including a cylindrical shaft having a shaft outer diameter and first and second ends, an aperture extending between said first and second ends for slidably receiving said axle, and an integral flange positioned at said second end;

wherein said flange has a flange outer diameter greater than said shaft outer diameter;

a plurality of hardened planar abrading discs removably and rotatably mounted on said bushing for continuous rotating bearing contact therewith, each of said plurality of abrading discs including a central mounting hole having a diameter intermediate said shaft outer diameter and said flange outer diameter and a plurality of teeth extending radially outwardly from said central mounting hole; and wherein said plurality of abrading discs are adapted to be retained between an inner wall of an abrading tool and said flange, said flange including a beveled surface to facilitate rotatable engagement with an arcuate inner surface of an outer wall of the abrading tool.

7. The abrading disc assembly according to claim 6 wherein said axle further includes a key means adjacent the under side of said head, said key means adapted to be engagable with a corresponding keyed radial aperture of an inner wall of an abrading tool for preventing rotation of said axle relative to the inner wall.

8. The abrading tool according to claim 1 wherein said housing includes a plurality of vent apertures disposed adjacent said plurality of abrading discs for facilitating removal of airborne dust.

9. The abrading tool according to claim 8 wherein said vent apertures are formed within said cylindrical outer wall and are circumferentially spaced intermediate said radial apertures.

10. The abrading tool according to claim 8 wherein said vent apertures are formed within said top wall near the outer periphery of said top wall.

11. An abrading tool for being driven in rotation by a spindle attached to a power tool, said abrading tool comprising:

a housing including a cylindrical outer wall defining a longitudinal axis and having an arcuate inner surface and a plurality of radial apertures, a cylindrical inner wall concentric to said outer wall and having a plurality of radial apertures coaxial to said radial apertures of said outer wall, and a top wall integral with said inner and outer walls and having an aperture coaxial with said longitudinal axis;

a plurality of vent apertures circumferentially disposed intermediate said radial apertures for facilitating removal of airborne dust;

a retaining cup including a cylindrical retaining wall concentrically received within said inner wall of said housing, and an end cap having an aperture coaxial with said longitudinal axis, said retaining wall and said inner wall defining a predetermined space of substantially uniform width therebetween;

a plurality of axles positioned in and extending between said coaxial radial apertures of said inner wall and said outer wall wherein said axles are in a circumferentially spaced relation normal to said longitudinal axis;

wherein each of said axles includes an integral head positioned in said predetermined space between said retaining wall and said inner wall for securing each of said plurality of axles in equal fixed relation with respect to said longitudinal axis;

a plurality of infrangible hardened cylindrical bushings removably and rotatably mounted on said plurality of axles between said outer wall and said inner wall of said housing;

wherein each of said plurality of bushings includes a cylindrical shaft having first and second ends, an aperture extending between said first and second ends for slidably receiving one of said plurality of axles, and an integral flange positioned at said second end having a beveled surface for rotatably engaging said arcuate inner surface of said outer wall of said housing; and a plurality of hardened planar abrading discs removably and rotatably mounted on each of said bushings for continuous rotating bearing contact therewith, said abrading discs retained between one of said flanges of said bushings and said inner wall of said housing whereby said abrading discs rotate and abrade a surface when in contact therewith as said housing is rotated and said abrading discs are prevented from contacting said arcuate inner surface of said outer wall.

* * * * *